US005308365A

United States Patent [19]

Kesling, Jr. et al.

[11] Patent Number: 5,308,365

[45] Date of Patent: May 3, 1994

[54] DIESEL FUEL

[75] Inventors: Haven S. Kesling, Jr., Drexel Hill; Lawrence J. Karas, West Chester; Frank J. Liotta, Jr., Collegeville, all of Pa.

[73] Assignee: ARCO Chemical Technology, L.P., Wilmington, Del.

[21] Appl. No.: 114,806

[22] Filed: Aug. 31, 1993

[51] Int. Cl.[5] ..... C10L 1/00; C10L 1/02

[52] U.S. Cl. ..... 44/447; 44/443; 44/448; 44/449

[58] Field of Search ..... 44/447, 448, 449, 443; C10L 1/00, 1/02

[56] References Cited

U.S. PATENT DOCUMENTS

| | | | |
|---|---|---|---|
| 2,184,956 | 12/1939 | Gilliland et al. | 44/443 |
| 2,331,386 | 10/1943 | Gaylor . | |
| 2,655,440 | 10/1953 | Barusch et al. . | |
| 2,763,537 | 9/1956 | Barusch et al. . | |
| 2,841,479 | 7/1958 | Hefner et al. | 44/443 |
| 3,577,228 | 5/1971 | Rai et al. . | |
| 3,594,138 | 7/1971 | Badin . | |
| 3,594,140 | 7/1971 | Badin . | |
| 3,615,292 | 10/1971 | Badin . | |
| 4,753,661 | 6/1988 | Nelson et al. . | |
| 4,891,049 | 1/1990 | Dillon et al. . | |
| 4,904,279 | 2/1990 | Kanne et al. . | |
| 5,004,480 | 4/1991 | Kanne . | |

FOREIGN PATENT DOCUMENTS

| | | |
|---|---|---|
| 80100827.7 | 9/1980 | European Pat. Off. . |
| 82109266.5 | 4/1983 | European Pat. Off. . |
| 59-232176 | 12/1984 | Japan . |
| 1246853 | 9/1971 | United Kingdom . |

OTHER PUBLICATIONS

Article entitled "Diesel Fuel Modification for Reduced Exhaust Emissions," by Richard E. Winsor and Danney E. Larkin. (Reference: *Impact of U.S. Environmental Regulations on Fuel Quality, ASTM STP* 1160, Kurt H. Strauss and Willaim Dukek, eds., American Society for Testing and Materials, Philadelphia, 1992.)

*Primary Examiner*—Prince Willis, Jr.
*Assistant Examiner*—Cephia D. Toomer
*Attorney, Agent, or Firm*—John C. Martin, Jr.

[57] ABSTRACT

The present invention relates to a low sulfur diesel fuel which contains a dialkyl and a trialkyl derivative of glycerol in amount sufficient to reduce particulate matter emissions.

9 Claims, No Drawings

DIESEL FUEL

BACKGROUND OF THE INVENTION

1. Field of the Invention

The present invention relates to an improved diesel fuel which has reduced particulate matter emission characteristics and which contains an effective amount of a dialkyl ether and/or trialkyl ether derivative of glycerol and most preferably the glycerol di-t-butyl ether product mixture prepared by glycerol etherification with isobutylene or t-butanol.

2. Description of the Prior Art

Diesel fuels are known which contain a synergistic cetane improving additive combination of a peroxidic component and an aliphatic polyether of the formula $R(—O—X)_nO—R^1$ where R and $R^1$ are alkyl groups, X is an alkylene group and n is an integer. See U.S. Pat. No. 2,655,440 and divisional U.S. Pat. No. 2,763,537.

European Application 80-100827.7 describes the use of various propylene glycol mono- an di-ethers as a component of diesel fuels. The compositions described in this reference involve a multicomponent formulation which includes poly-ethers, acetals, lower alkanols, water and only up to 85 volume % diesel fuel hydrocarbons.

U.K. 1,246,853 describes the addition of dialkyl ethers of propylene glycol as smoke suppressants in diesel fuel.

U.S. Pat. No. 4,753,661 describes a fuel such as diesel fuel containing a conditioner which comprises a polar oxygenated hydrocarbon, a compatibilizing agent which is an alcohol, aromatics, and a hydrophilic separant which may be a glycol monoether.

Japanese Published Application 59-232176 describes the use of the di-ethers of various polyoxyalkalene compounds as diesel fuel additives.

The addition of glycol ethers and metallic smoke suppressants have been found to reduce the smoke and soot emissions. These metallic smoke suppressants are typically metal salts of alkanoic acids. Both the health and environmental risks of these salts, especially those of barium, are of concern. See U.S. Pat. Nos. 3,594,138, 3,594,140, 3,615,292 and 3,577,228.

European Application 82-109,266.5 describes the use of ethers to reduce soot. However, a number of these ethers are unable to be used commercially in the U.S. because the resulting fuel does not meet the flash point specification of 126° F. This application also teaches that glycol ethers are not highly effective at reducing exhaust emissions. Based on these teachings, our invention would be unexpected.

Japanese Patent Application 59-232176 teaches that glycol ethers of the formula $R_1—O—(CHR_2—CH_2—O—)_nR_3$ where n is less than five have the effect of reducing particulate, CO and HC emissions which effect is weak. This is in direct contrast to our invention.

Winsor and Bennethum (SAE 912325) describe the use of the ether diglyme to reduce particulate emissions. In addition to being costly to produce, diglyme is highly toxic and has been associated with increased rates of miscarriages. Glycol ethers based on the higher alkylene oxides, especially propylene and the butylenes, are far less toxic than those based on ethylene oxide. Glycol ethers based on ethylene oxide also have unfavorable water partition coefficients. The water partition coefficient for diglyme is greater than 17. Thus virtually eliminating it for any commercial use as a diesel fuel additive.

The addition of dialkyl carbonates and dialkyl dicarbonates, particularly dimethyl carbonate, to diesel fuel has been described to reduce exhaust emissions from compression ignition engines. See U.S. Pat. Nos. 2,311,386, 4,891,049, 5,004,480 and 4,904,279. The high volatility of the lower alkyl carbonates prevents their addition in substantial amounts to typical D-2 diesel fuel. While some dicarbonates have lower volatilities, their poor hydrolytic stability precludes their commercial use.

The Clean Air Act Amendments of 1990 have established certain emission standards for heavy duty diesel engines, in particular with regard to nitrogen oxide and particulate matter emissions. The contribution of diesel fuel sulfur content to exhaust particulates has been well established, and has led to an EPA regulation which will require highway diesel fuels to contain no more than 0.05 wt.% sulfur. In 1991, particulate matter emissions were required to drop from 0.60 to 0.25 grams/BHP-hr., and in 1994 the emission limit is 0.10. Similarly, nitrogen oxide will decrease from 6.0 to 5.0 in 1994 and from 5.0 to 4.0 grams/BHP-hr. in 1998. The California Air Resources Board (CARB) has issued regulations that are viewed as more difficult to meet than the EPA targets. To qualify a diesel fuel in California, emissions must be no greater than the CARB reference fuel which contains 0.05 wt.% maximum sulfur, 10% maximum aromatics and a minimum cetane number of 48.

Many strategies are being used by the industry to reduce emissions. Improved heavy duty diesel engine designs including higher injection pressures, turbocharging, air intercooling, retarded injection timing through electronic tuning control, exhaust gas recycle and exhaust aftertreatment devices all lower emissions.

For this advanced technology to work, a high quality, low emissions diesel fuel is required in addition to the use of various fuel additive improvements including cetane improver use, diesel fuel detergents to keep fuel injectors clean and improved low ash engine oils. A combination of these strategies will be utilized to meet new clean air standards. The key issue is to find the most effective combination of technologies which offer the best cost/performance.

Fuel regulations, especially those promulgated in California, will require costly changes in diesel fuel composition. Desulfurization to achieve the 0.05 wt.% sulfur target is easily accomplished through mild hydrogenation. However, refiners must use deep hydrogenation to decrease aromatic content from the current 20-50% aromatic level down to 10%. Several refiners have elected to exit the California diesel fuel market rather than making the high capital investment required for deep hydrogenation. At least one refiner was able was able to qualify a diesel fuel for California by lowering the aromatics to 19% and increasing the cetane number from 43 for a typical fuel up to around 60 using an alkyl nitrate cetane improver.

The present invention relates to the use of ether derivatives of glycerol which, when incorporated in standard 30-40% aromatic containing diesel fuel, provides reduced emissions of particulate matter, hydrocarbons, carbon monoxide and unregulated aldehyde emissions. For 1994, the engine manufacturer strategy to reduce emissions in order to meet the emission regulations involves using electronic tuning to reduce particulates.

In this strategy, nitrogen oxide, hydrocarbons, and carbon monoxide emissions are within EPA requirements. However, for 1998, nitrogen oxide emissions need to be further reduced. If an oxygenated fuel can lower particulate matter emissions another 10-20%, this will provide additional tuning flexibility for nitrogen oxide. The strategy would be to lower particulates to meet the 0.1 gram/BHP-hr. target using a combination of oxygenate additive, cetane additive, and tuning. This widens the window for nitrogen oxide tuning which needs to be reduced from 5.0 to 4.0 grams/BHP-hr. Particulate reductions will also provide an opportunity to further lower nitrogen oxide using exhaust gas recycle. At high particulate matter levels, the particulates block and foul the exhaust gas recycle lines and orifices, and contaminate engine oil. Lower particulates via the use of ether derivatives of glycerol could allow greater use of this new technology.

BRIEF DESCRIPTION OF THE INVENTION

In accordance with the invention, reduced emissions of particulate matter are achieved with diesel fuel having incorporated therein an effective amount of an ether derivative of glycerol having the formula

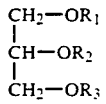

where $R_1$, $R_2$ and $R_3$ are each hydrogen or a $C_1$-$C_{10}$ alkyl group with the proviso that at least two of $R_1$, $R_2$ or $R_3$ are the $C_1$-$C_{10}$ alkyl group. Preferably $R_1$ and $R_3$ are the same alkyl group, such as methyl, ethyl, propyl, isopropyl, n-butyl, isobutyl, t-butyl, amyl, t-amyl, hexyl, hextyl, octyl, nonyl, decyl and the like. Most preferably, $R_1$ and $R_3$ are the same $C_4$-$C_5$ tertiary alkyl group. Mixtures can be employed including mixtures of additives with different alkyl groups, mixtures of 1,2 diether, 1,3 diether and 1,2,3 triether are preferred.

Especially suitable for use according to the invention is the mixture of 1,2 di-t-alkyl, 1,3-di-t-alkyl and 1,2,3-tri-t-alkyl glycerol ethers prepared by glycerol etherification with an isoalkene such as isobutylene or t-amylene or with a t-alkyl alcohol such as t-butanol or t-amyl alcohol.

DETAILED DESCRIPTION

The hydrocarbon based diesel fuels utilized in the practice of this invention are comprised in general of mixtures of hydrocarbons which fall within the diesel fuel boiling range, typically about 160° to about 370° C. The fuels are often referred to as middle distillate fuels since they comprise the fractions which distill after gasoline. The diesel fuels of the invention have a low sulfur content, i.e. not more than 500 ppm by weight, preferably not more than 100 ppm and preferably not more than 60 ppm sulfur by weight. Aromatic content is in the range of 0-50% by volume, preferably 20-35% by volume.

The glycerol ether component employed in the invention has the formula

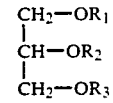

where $R_1$, $R_2$ and $R_3$ are each hydrogen or a $C_1$-$C_{10}$ alkyl group with the proviso that at least two of $R_1$, $R_2$ or $R_3$ are the $C_1$-$C_{10}$ alkyl group. Preferably $R_1$ and $R_3$ are the same alkyl group; most preferably, $R_1$ and $R_3$ are the same $C_4$-$C_5$ tertiary alkyl group.

Especially preferred additives are 1,3 di-t-butyl glycerol or mixtures of 1,3 di-t-butyl glycerol with 1,2 di-t-butyl glycerol and 1,2,3 tri-t-butyl glycerol. These additives have good solubilities in diesel fuel hydrocarbons, have superior water partition coefficient characteristics and are effective in reducing particulate matter emissions.

The diesel fuel formulations of the present invention consist essentially by volume of at least 85% diesel fuel hydrocarbons and 0.1 to up to 15% of the glycerol ether, preferably about 0.2 to 10% of the glycerol ether.

Conventional additives and blending agents for diesel fuel may be present in the fuel compositions of this invention in addition to the above components. For example, the fuels of this invention may contain conventional quantities of such conventional additives as cetane improvers, friction modifiers, detergents, antioxidants, heat stabilizers and the like. Especially preferred diesel fuel formations of the invention comprise diesel fuel hydrocarbons and monoalkyl ether as above described together with peroxidic or nitrate cetane improvers such as ditertiary butyl peroxide, amyl nitrate, ethyl hexyl nitrate and the like.

The addition of the glycerol ether additives in accordance with the invention results in a slight increase in $NO_x$ emissions; however, the use of sufficient known cetane improvers to increase the fuel cetane value by 5-10 units reduces the $NO_x$ emissions well below the level of the base reference fuel.

In addition to the use of the additives of the present invention in conventional carbon diesel fuels as above described, the additives also find utility with the newer generation of biodiesel fuels prepared from various vegetable type oils. Such biodiesel fuels are esters of naturally occurring fatty acids such as the product resulting from esterification of the tri-glycerides which form the predominance of the vegetable oils.

In a particularly preferred practice of the invention wherein soybean oil is converted by conventional techniques to methyl soyate and glycerol, in accordance with the invention the glycerol is etherified by reaction with isobutylene or t-butanol or the corresponding $C_5$ materials, in order to produce a product mixture comprised primarily of the 1,2-di-t-alkyl ether, the 1,3-di-t-alkyl glycerol and the 1,2,3-tri-t-alkyl glycerol. Especially advantageous in this reaction is the use of a highly cross-linked sulfonic acid resin catalyst such as Amerlyst XN1010with an isoalkene to glycerol ratio of 2:1 or higher at temperatures in the range of 50°-150° C., preferably 55°-75° C. So far as is known, the product mixtures resulting from this reactions using this catalyst are themselves novel and generally comprise 60 to 70% by weight 1,3-di-t-alkyl glycerol, 5 to 15 wt.% 1,2-di-t-alkyl glycerol and 15 to 30 wt. % 1,2,3-tri-t-alkyl glycerol.

The glycerol ether product is soluble in all portions with the methyl soyate, and indeed it has been found that a blend of the glycerol ether with methyl soyate has certain special and unique utilities. For example, a blend of about 60 to 90 vol.% methyl soyate with 10 to 40% of the glycerol ether product mixture above described in turn forms an extremely satisfactory agent for blending with conventional hydrocarbon diesel fuels for purposes of reducing emissions. Generally, the soyate ether mixture is suitably blended in an amount of 1 to 30 vol.% with conventional low sulfur diesel fuels in order to provide a resulting fuel with enhanced emission reduction characteristics.

An additional feature of the above described mixtures of the methyl soyate with the glycerol ether mixture is that the resulting mixture possesses unique solvent characteristics. In fact, the resulting mixture can be termed an environmentally friendly solvent and can be used to replace less friendly solvents in a wide number of solvent applications.

We are aware of certain prior art which relates to etherification of glycerol using various acidic catalysts. Such are is illustrated by U.S. Pat. No. 1,968,033 and Czechoslovak 190,755. In each instance, the product mixture produced by such procedures does not appear to have the yield, composition or utility of the mixtures employed in accordance with the present invention. Product yields are low due to significant t-butyl alcohol formation. Monoethers, described in the references are highly water soluble and thus are totally unsuitable as diesel blending agents. There appears to be no reference in the procedures described in the said patents of the production of ether mixtures containing the 1,2,3 trialkyl ether as is a requirement in connection with the compositions of the present invention.

EXAMPLE 1

Diesel Fuel Applications

A. Fuel Solubility

Fuel solubility is a primary requirement for diesel fuel applications. Not all oxygenates that are highly polar have good solubility in the new low aromatic reformulated diesel fuels. The solubility of a 70:10:20 1,3-di, 1,2-di, and 1,2,3-tri-t-butyl glycerol mixture by weight which is used in this and the following examples was determined in EPA 1991 certification diesel fuel which contained 400 ppm sulfur and 31% aromatics, and in 1993 CARB certification diesel fuel which contained 400 ppm sulfur and 10% aromatics. Results show the t-butyl glycerol mixture has infinite solubility.

Experiments also show the t-butyl glycerol product mixture has infinite solubility in methyl soyate biodiesel fuels and in a wide variety of aliphatic hydrocarbons such as pentane and hexane. An 80:20 by volume mixture of methyl soyate and the above t-butyl glycerol mixture was prepared and blended at 30% with conventional EPA certification diesel fuel. Again, the methyl soyate/glycerol either mixture is completely soluble in the diesel fuel. From all the above results, it can be concluded that the product mixture obtained from glycerol etherification with isobutylene will be completely miscible with the new generation of reformulated diesel fuels.

B. Fuel Flashpoint

The diesel fuel flashpoint with the oxygenate additive must be greater than 126° F. to use existing pipelines for distribution. Results show the flashpoint of a blend of 5% by volume of the above t-butyl glycerol mixture in EPA certification diesel fuel is 170° F. Results were also acceptable for 80:20 methyl soyate / t-butyl glycerol mixture blends at concentrations of 5-30% in EPA certification diesel fuels. From the above results, it can be concluded that diesel fuel blends prepared from conventional diesel fuels and containing the additives of the invention will have acceptable flashpoints and can be transferred through the normal pipeline distribution system.

C. Water Partitioning

Loss of diesel additives through water extraction is a significant environmental and performance issue. Both a high degree of water solubility in the fuel blend and high degree of water partitioning of the additive are undesirable. Additives that increase the water solubility in diesel above 0.05 wt.% are unacceptable. A 5 volume % blend of the t-butyl glycerol product mixture described above in EPA certification diesel fuel was prepared and evaluated for additive and water partitioning. The additive containing fuel was exposed to water at a 10:1 fuel/water ratio. After vigorous shaking, the layers were separated by centrifuging. The diesel fuel layer had a water concentration of 300 ppm's indicating very little water partitions into the diesel fuel phase. The t-butyl glycerol product mixture partition coefficient was calculated to be 0.1 indicating little t-butyl glycerol was removed from the diesel fuel phase into the aqueous phase.

D. Cetane Number

Some oxygenated diesel fuel additives can reduce the natural cetane number of the base diesel fuel. A 5 volume % blend of the di-t-butyl glycerol product mixture described above with EPA certification diesel fuel (31% aromatic content) was prepared and sent to an outside laboratory for cetane determination. Results are as follows:

| Fuel Type | Cetane Number |
|---|---|
| Reference Diesel Fuel | 43 |
| Oxygenated Diesel Fuel | 44 |

No decrease in cetane number is observed when the di-t-butyl glycerol product mixture described above is blended with conventional diesel fuel.

EXAMPLE 2

Emission Testing

Oxygenated diesel fuels prepared using the di-t-butyl glycerol product mixture above described with conventional EPA 1991 certification, 400 ppm sulfur, 31% aromatic, and 43 cetane diesel fuel are evaluated for emission reduction potential. The study was based on extrapolations from studies conducted using a prototype 1991 Detroit Diesel Series 60 heavy duty engine. Hot-start transient emissions are measured using the standard EPA transient test cycle. Diesel exhaust emissions, including: oxides of nitrogen ($NO_x$), carbon monoxide (CO), total hydrocarbons (HC), particulate matter (PM) and various non-regulated aldehyde and ketone emissions, benzene and particulate composition.

They di-t-butyl glycerol product mixture above described in amounts of from 1 to 5% in EPA certification diesel are evaluated. The di-t-butyl glycerol product mixture combined with methyl soyate 20:80 is also blended at the 5 to 30% level with EPA certification diesel and evaluated for emission reduction potential. Both blends result in significant improvements in ability to reduce emissions. Both carbon monoxide, hydrocarbons, particulate matter, aldehyde/ketones and benzene are reduced by the additive addition. Although $NO_x$ emissions, in general, show small increases, the addition of chemical cetane improvers can be utilized to overcome and reduce the $NO_x$ emission increase.

When the di-t-butyl glycerol mixture is added, the most significant emission reductions are observed for particulate matter. Particulate emission reduction results are obtained by extrapolation from results achieved with comparable systems are as follows:

| Oxygen Additive | Oxygen Content (wt. %) | PM (G/B.HP-Hr.) |
|---|---|---|
| EPA Base Fuel | 0 | 0.182 |
| MS (5%) | 0.59 | 0.174 |
| DTBG (1%) | 0.56 | 0.169 |
| DTBG (2%) | 1.12 | 0.157 |
| DTBG (5%) | 2.80 | 0.135 |
| MS/DTBG (5%) | 1.03 | 0.151 |
| MS/DTBG (10%) | 2.06 | 0.144 |

MS = methyl soyate;
DTBG = 70:10:20 1,3-di, 1,2-di, and 1,2,3-tri-t-butyl glycerol;
MS/DTBG = 80:20 blend.
EPA base reference fuel contained 31% aromatics, 400 ppm sulfur, and had a 43 natural cetane number.

We claim:

1. A fuel composition comprised of hydrocarbons boiling in the diesel fuel range at about 160° C. to about 370° C. and containing up to 500 ppm sulfur, and a particulate emission reducing amount of a glycerol ether additive having the formula $$\begin{array}{l} CH_2-OR_1 \\ | \\ CH-OR_2 \\ | \\ CH_2-OR_3 \end{array}$$

wherein $R_1$, and $R_2$ and $R_3$ are each hydrogen or a $C_1$–$C_{10}$ alkyl group with the proviso that at least two of $R_1$, $R_2$ or $R_3$ are $C_1$–$C_{10}$ alkyl group.

2. The composition of claim 1 wherein the said additive is used in combination with methyl soyate.

3. The composition of claim 1 comprised of at least 70 vol.% diesel hydrocarbons together with 1–30% of said glycerol ether or the combination of methyl soyate and said ether.

4. The fuel composition of claim 1 wherein $R_1$ and $R_3$ are $C_4$–$C_5$ tertiary-alkyl groups.

5. The fuel composition of claim 1 wherein $R_1$ and $R_2$ and $R_3$ are $C_4$–$C_5$ tertiary-alkyl groups.

6. The fuel composition of claim 1 wherein $R_1$ and $R_3$ are tertiary alkyl groups and $R_2$ is hydrogen.

7. The fuel composition of claim 1 which contains 0.1 to 15 vol.% of said additive.

8. The fuel composition of claim 1 which contains 0.2 to 10 vol.% of said additive.

9. The fuel composition of claim 1 also containing a cetane improving amount of a peroxidic or nitrate cetane improver.

* * * * *